US006648196B2

(12) United States Patent
Morrison et al.

(10) Patent No.: US 6,648,196 B2
(45) **Date of Patent: *Nov. 18, 2003**

(54) PIECE OF BAGGAGE HAVING AN ADJUSTABLE STRAP FOR ALTERNATIVELY SUPPORTING THE PIECE OF BAGGAGE FROM ONE'S WAIST OR SHOULDER

(75) Inventors: Kathleen Morrison, Dittmer, MO (US); Mark Nordstrom, Brentwood, TN (US)

(73) Assignee: TRG Accessories, LLC, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/241,938

(22) Filed: Sep. 12, 2002

(65) Prior Publication Data

US 2003/0006261 A1 Jan. 9, 2003

Related U.S. Application Data

(63) Continuation of application No. 09/756,624, filed on Jan. 8, 2001, now Pat. No. 6,474,523.

(51) Int. Cl.[7] ..... A45F 3/02; A45F 5/00

(52) U.S. Cl. ..... 224/578; 224/610; 224/614; 224/664; 224/197

(58) Field of Search ..... 224/578, 610, 224/579, 611, 618, 664, 575, 577, 614, 615, 616, 617, 619, 620, 621, 197, 199, 580; D3/215, 327

(56) References Cited

U.S. PATENT DOCUMENTS

| | | | | | |
|---|---|---|---|---|---|
| 778,636 | A | | 12/1904 | Coran | |
| 4,116,310 | A | * | 9/1978 | Shields | 224/576 |
| 4,119,248 | A | | 10/1978 | Butler et al. | |
| 4,545,414 | A | * | 10/1985 | Baum | 224/580 |
| 4,733,806 | A | | 3/1988 | Sloop | |
| 5,119,910 | A | | 6/1992 | Heggeland | |
| D328,186 | S | | 7/1992 | Hanke | |
| 5,285,833 | A | | 2/1994 | Haxby | |
| 5,775,558 | A | | 7/1998 | Montalbano | |
| 5,931,363 | A | * | 8/1999 | Ammons, Jr. | 224/602 |
| 5,964,384 | A | | 10/1999 | Young | |
| 6,021,937 | A | * | 2/2000 | Schryver et al. | 224/610 |
| 6,209,769 | B1 | | 4/2001 | Seals et al. | |
| 6,375,640 | B1 | * | 4/2002 | Teraoka | 604/263 |
| 6,474,523 | B2 | * | 11/2002 | Morrison et al. | 224/578 |

* cited by examiner

*Primary Examiner*—Stephen K. Cronin
(74) *Attorney, Agent, or Firm*—Lewis, Rice & Fingersh LC

(57) ABSTRACT

A piece of baggage is provided with a pack portion having a strap with end portions that can be adjusted to extend horizontally from the sides of the pack portion or, alternatively, upwardly from the pack portion. When the strap ends are oriented extending horizontally from the pack portion, the piece of baggage can be worn as a conventional lumbar pack. When the strap ends are oriented to extend upwardly from the pack portion, the piece of baggage can be supported from a person's shoulder in a comfortable manner similar to a conventional shoulder bag.

13 Claims, 5 Drawing Sheets

PIECE OF BAGGAGE HAVING AN ADJUSTABLE STRAP FOR ALTERNATIVELY SUPPORTING THE PIECE OF BAGGAGE FROM ONE'S WAIST OR SHOULDER

CROSS REFERENCE TO RELATED APPLICATIONS

This application is a continuation of U.S. patent application Ser. No. 09/756,624 filed Jan. 8, 2001, now U.S. Pat. No. 6,474,523 the entire disclosure of which is herein incorporated by reference.

BACKGROUND OF THE INVENTION (1) Field of the Invention

This invention pertains to the field of baggage and travel gear. More particularly, this invention pertains to a small pack having a pivotally connected strap that allows the pack to be worn as either a lumbar pack or as a shoulder bag. When worn as a lumbar pack, the piece of baggage can be adjusted such that the opposite end portions of the strap extend horizontally in opposite directions from the sides of the pack to allow the strap to be wrapped around a person's waist in a manner similar to a conventional lumbar pack. When desired to be worn as a shoulder bag, the piece of baggage can be adjusted such that the end portions of the strap extend upwardly from the pack to allow a person to support the piece of baggage from his or her shoulder in a manner similar to a conventional shoulder bag.

(2) Description of the Related Art

Travelers often find it desirable to carry small packs or pouches for carrying frequently used items such as a wallet, credit cards, hand-held computers, eye glasses, passports, cameras, and the like. Within the past few decades, it has become common for travelers to use packs known as lumbar or fanny packs that are configured to be supported from a person's waist. Such lumbar packs frequently have a strap with opposite ends that extend horizontally from the pack portion of the piece of baggage. It is also common for travelers to use small packs configured in a purse-like manner having a strap with opposite ends that extend upwardly from the pack portion such that the pack can be supported from a person's shoulder. In either configuration, such packs provide advantages over storing items in pockets of clothing in that a traveler need not constantly switch personal items from the pockets of one garment to the next as he or she changes attire.

Lumbar packs typically comprise a pack portion and an adjustable length strap. The pack portion typically has one or more storage compartments configured and adapted to hold specific items. Such compartments often have a closure means, such as a zipper, for preventing items from being removed from the compartments inadvertently.

The strap of a waist supported pack is typically made of thin woven nylon webbing that is approximately one inch wide and typically has a buckle or clip that allows the strap to be separated into two portions for securing and removing the pack from around the person's waist. Such buckles or clips are well known in the art and often include one or more means for adjusting the length of the strap such that it fits snuggly around a person's waist.

Waist supported packs are typically configured with the opposite end portions of the strap attached to the pack portion in an orientation such that the end portions are aligned with one another extending in opposite horizontal directions from the pack portion. To minimize movement of lumbar packs, the strap ends are typically attached adjacent the back side of the pack portion which engages against the waist when worn with the width of each of the strap ends being vertically oriented such that the strap rests flush against a persons waist when the piece of baggage is worn. To reduce stresses on the piece of baggage where the strap ends are attached to the pack portion and to provide additional comfort for the wearer, it is known to connect the ends of the strap to the pack portion using tapered ears or tabs. Such ears or tabs are often made of the same material as the pack portion and taper down as they extend from the pack portion to where they connect to the ends of the straps.

Lumbar packs are advantageous in that they fit tightly around a person's waist where they will not swing or move around relative to the wearer when worn. Additionally, the wearer of a lumbar pack is free to simultaneously carry shoulder bags or packs without it becoming cumbersome or awkward. Thus, lumbar packs are a highly practical form of baggage for persons who are walking or performing physical activities.

Despite the advantages of lumbar packs, such baggage can be cumbersome and uncomfortable when a person sits down. As a result, travelers generally remove such packs from their waist when sitting for a prolonged period of time, such as when driving or flying. Once removed, such packs become awkward to hold and are often set aside where they may inadvertently be left behind.

Shoulder supported packs, like waist supported packs discussed above, generally comprise a pack portion and a strap. However, unlike waist supported packs, the end portions of the strap of a shoulder supported pack are typically attached such that they extend vertically from the pack portion. This configuration allows a shoulder supported pack to hang from a traveler's shoulder without twisting the strap or tilting the pack portion, as would occur if end portions of the strap extended horizontally from the pack portion in a manner similar to a lumbar pack. Although less common than with waist supported packs, the straps of a shoulder supported pack may also be adjustable in length.

Shoulder supported packs are advantageous in that they can easily be repositioned to hang alternatively against a person's back, side, or front with little effort. This allows a person to easily sit down without removing the pack from his or her shoulder. However, this advantage becomes a disadvantage when the person is walking or performing other physical activities which may cause the pack to swing back and forth or away from the user's body and generally become burdensome.

The present invention overcomes the disadvantages associated with both prior art waist supported packs and shoulder supported packs by providing a pack portion having a pivotally connected strap that allows the pack to be worn alternatively as a waist supported pack and as a shoulder supported pack. Thus, the invention provides all of the advantages described for both shoulder supported packs and waist supported packs while eliminating the disadvantages associated therewith.

SUMMARY OF THE INVENTION

The piece of baggage of the present invention is configured to appear and function as a conventional lumbar pack. When functioning as a conventional lumbar pack, the support strap extends horizontally from the opposite sides of the pack portion of the piece of baggage. However, unlike conventional lumbar packs, the piece of baggage of the present invention can be adjusted such that the support strap extends upwardly from the pack portion for supporting the piece of baggage from a person's shoulder in a manner similar to a conventional shoulder bag. The piece of baggage of the invention can be made from materials commonly used to fabricate lumbar packs and can be fabricated at comparable costs.

In general, the preferred embodiment of the piece of baggage of the present invention comprises a pack portion, a strap, and a pair of connectors. The pack portion is preferably similar in size and shape to a conventional pack portion of a lumbar pack and has at least one compartment for storing items to be carried. The strap has a buckle such that it can be wrapped around a persons waist and is adjustable in length to fit comfortably therearound. The connectors attach the end portions of the strap to the pack portion and can be adjusted to allow the end portions of the strap to extend from the pack portion in alternative orientations. In one orientation, the end portions of the strap extend horizontally away from each other such that the piece of baggage can be worn as a conventional lumbar pack without discomfort. In a second orientation, the end portions of the strap extend upwardly from the pack portion such that the piece of baggage can be worn comfortably over a person's shoulder as a conventional shoulder bag. In the preferred embodiment of the piece of baggage of the invention, the connectors include detent mechanisms for locking the end portions of the strap in one of the various orientations relative to the pack portion.

While the principle advantages and features of the present invention have been described above, a more complete and thorough understanding and appreciation for the invention may be attained by referring to the drawings and detailed description of the preferred embodiment which follow.

BRIEF DESCRIPTION OF THE DRAWINGS

Reference characters in the written specification indicate corresponding parts throughout the several views of the drawings.

DETAILED DESCRIPTION OF THE INVENTION

Figure 1:
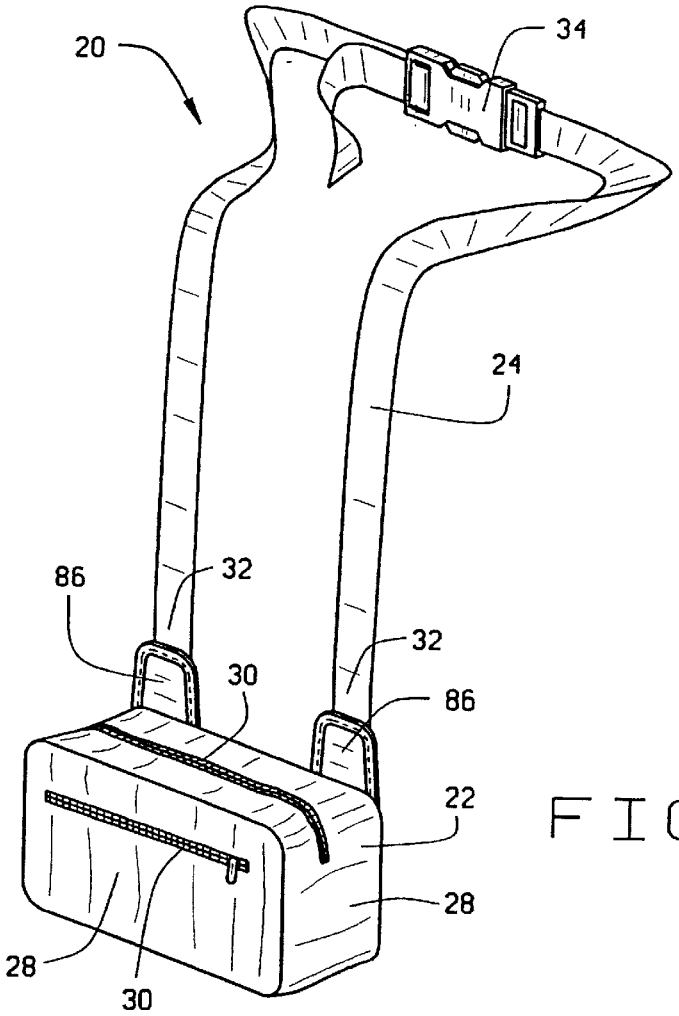
FIG. 1 is an isometric view of the piece of baggage of the preferred embodiment of the invention shown in a configuration for being supported from a person's shoulder.
Figure 2:
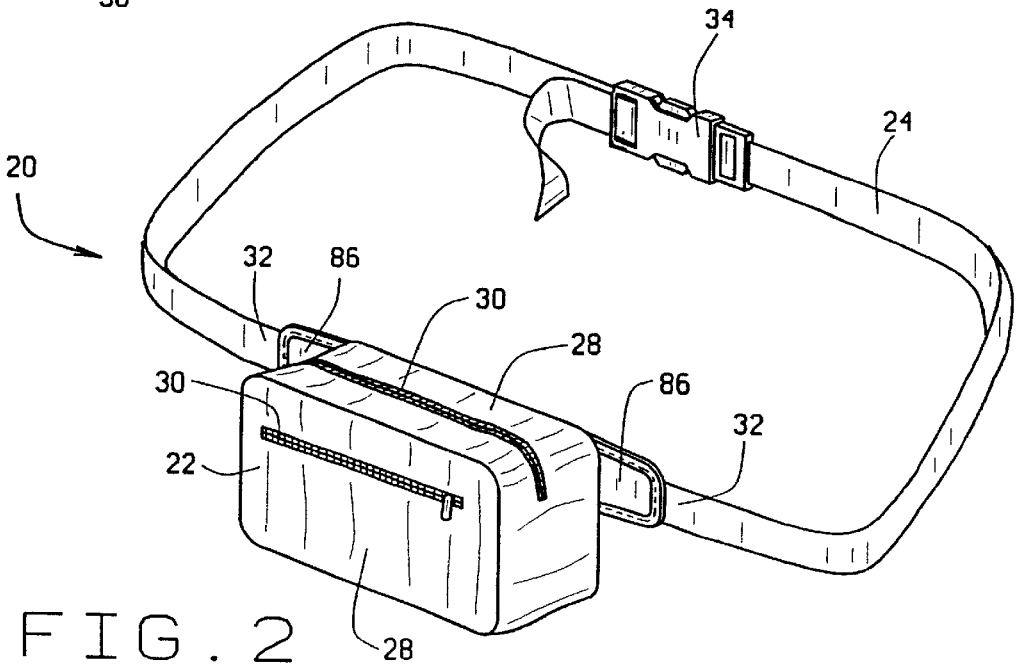
FIG. 2 is an isometric view of the piece of baggage of the preferred embodiment of the invention shown in a configuration for being supported from a person's waist.
Figure 14:
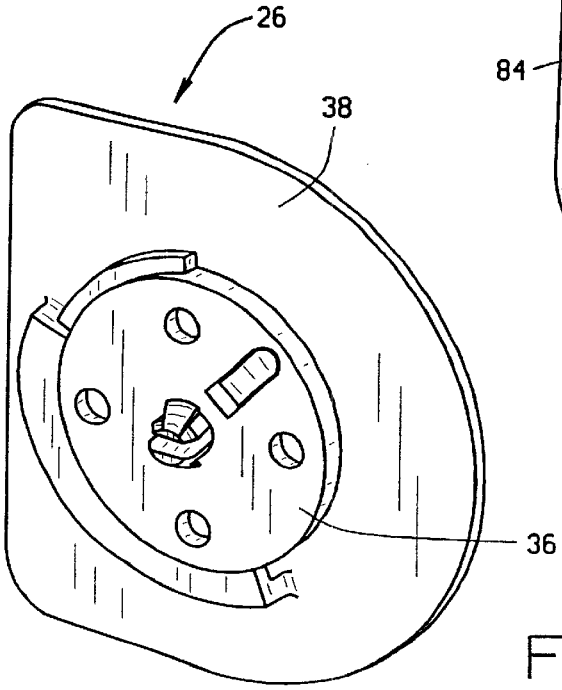
FIG. 14 is an assembly view of the male and female portions of the connector shown in FIGS. 5 and 9.

The preferred embodiment of the piece of baggage 20 of the invention is shown in FIG. 1 in a configuration for being supported from a person's shoulder and is shown in FIG. 2 in an alternative configuration for being supported from a person's waist. The piece of baggage of the preferred embodiment is generally comprised of a pack portion 22, a strap 24, and a pair of connectors 26 (shown in FIG. 14).

The pack portion 22 of the preferred embodiment is formed of nylon, canvas, leather, or other suitable pliable materials and preferably has a plurality of compartments 28 for storing various items such as wallets, credit cards, hand-held computers, sun glasses, passports, and other items often carried when traveling. The compartments 28 of the pack portion 22 preferably have zipper closure mechanisms 30 for preventing such items from inadvertently being removed from the compartments. However, it should be understood that the details and specifics of the pack portion 22 are not critical to the invention and numerous styles of pack portions are known in the art that could be utilized in place of the pack portion 22 of the preferred embodiment of the invention shown.

The strap 24 portion of the piece of baggage 20 of the preferred embodiment has opposite lengthwise end portions 32 and has a cross-section having a substantially greater width than thickness. The strap 24 is preferably formed of woven nylon, known in the industry as webbing, and has a quick-release buckle 34 located at a point along its length. The quick-release buckle 34 allows the strap 24 to be separated into two portions and is a standard polymeric buckle of the type that also provides a means for adjusting the length of the strap to fit comfortably around a person's waist or shoulder.

The connectors 26 are utilized to attach the strap 24 of the piece of baggage 20 to the pack portion 22. Each of the connectors 26 comprises a female portion 36 and a male portion 38, as shown in FIGS. 3–14. The female portion 36 and the male portion 38 of each of the connectors 26 are mirror images of those of the other connector, and for purposes of this description, only the female portion and male portion of one of the connectors is described below.

The female portion 36 of a connector 26 is shown in FIGS. 5 through 8 and is preferably formed of a polymeric material, although other materials may be employed. The female portion 36 of the connector 26 comprises a thin, cylindrical main body 40 having a front face 42, a rear face 43, and a centrally oriented through-hole 44. A plurality of mounting holes 46 are countersunk into the front face 42 and are positioned circumferentially about the through-hole 44 and extend axially through the main body 40. A detent tab 48 is formed in the main body adjacent the front face 42. The detent tab 48 has an arm portion 50 formed by an elongated U-shape slot 51 through the main body 40. The elongation of the slot 51 gives the arm portion 50 a resilience. The arm portion extends radially from the main body through hole 44 flush with the front face 42 of the main body 40 to a semispherical protrusion 52 that extends outwardly from the front face 42. Finally, a semicircular ridge 54 extends partially around the perimeter of the front face 42 of the main body 40.

The corresponding male portion 38 of the same connector is shown in FIGS. 9 through 13 and is also preferably formed of a polymeric material although other materials may be used. The male portion 38 of comprises a D-shaped main body 56 having a centrally positioned pair of closely spaced locking tabs 58 that extend perpendicular from its front face 60. The locking tabs 58 each have a semicylindrical surface 62 extending perpendicular from the front face 60 of the main body 56. A frustoconical tapered portion 64 extends from the distal end of each locking tab 58 and terminates at a locking surface 66 that is parallel to and spaced from the front face 60 of the main body 56. A plurality of detent holes 68 are circumferentially spaced partially around the locking tabs 58 and extend through the main body 56. An arcuate protrusion 70 extends from the face of the main body 56 partially around the locking tabs 58. The arcuate protrusion 70 has an arcuate flange 72 that cantilevers radially inward from the protrusion and defines an arcuate slot 74 between the flange and the front face 60 of the main body 56. The back side 76 of the main body 56 has a protruding contoured surface such that the main body 56 tapers down in thickness towards its upper 78, lower 80, and semicircular edges 82. Additionally, three arcuate openings 84 extend through the main body 56. The openings 84 allow the flange 72 of the arcuate protrusion 70 and the locking surfaces 66 of the locking tabs 58 to be molded integrally with the main body 56 using two part molds or dies.

Figure 3:
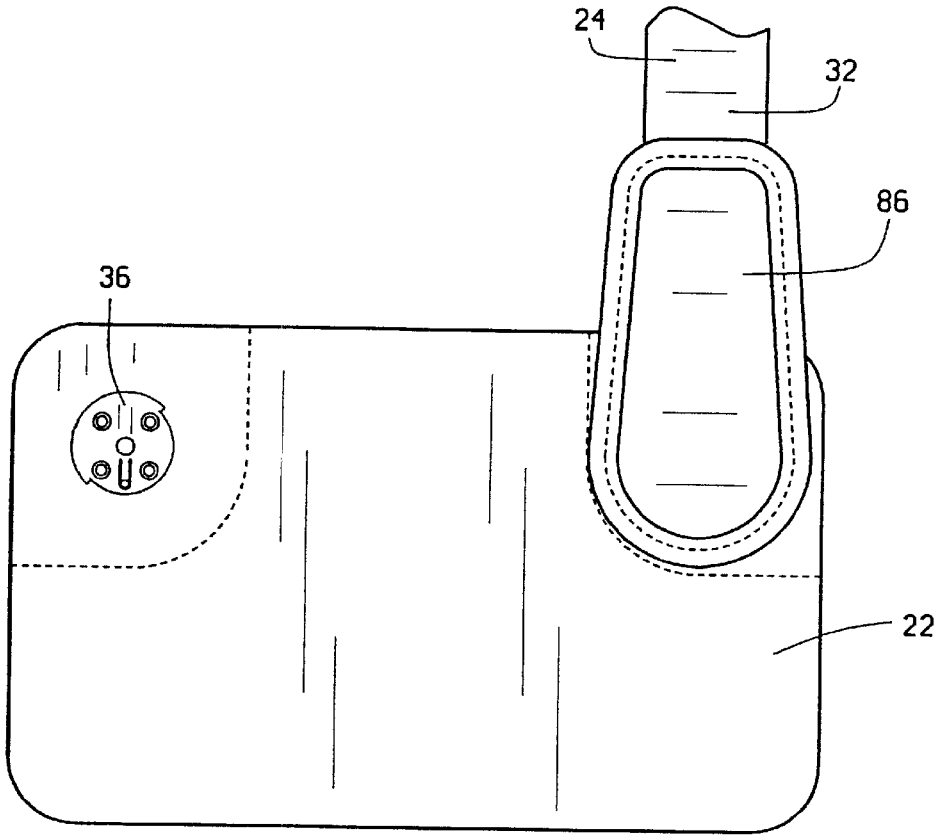
FIG. 3 is a partial rear view showing the back of the pack portion of the preferred embodiment with one of the end portions of the strap removed therefrom to show the position of the female portion of a connector relative to the pack portion.

The various components of the preferred embodiment of the piece of baggage 20 described above are configured to be permanently secured to each other. A female portion 36 of a connector 26 is attached to the backside of the pack portion 22 adjacent each opposite upper corner of the pack portion, as shown in FIG. 3. Each of the female portions 36 is oriented with its front face 46 facing away from the pack portion 22 and its ridge 54 extending toward the adjacent corner of the pack portion using fasteners. This is preferably done using fasteners such as rivets or screws (not shown) that extend through its mounting holes and that have heads sized to fit within the countersink of the mounting holes 46 such that the front face 42 of the female portions 36 of the connectors 26 remain flush. Other fastening methods achieving this result may also be used. When so attached, each female portion 36 of each connector 26 remains fixed in position and orientation relative to the backside of the pack portion 22.

Figure 4:
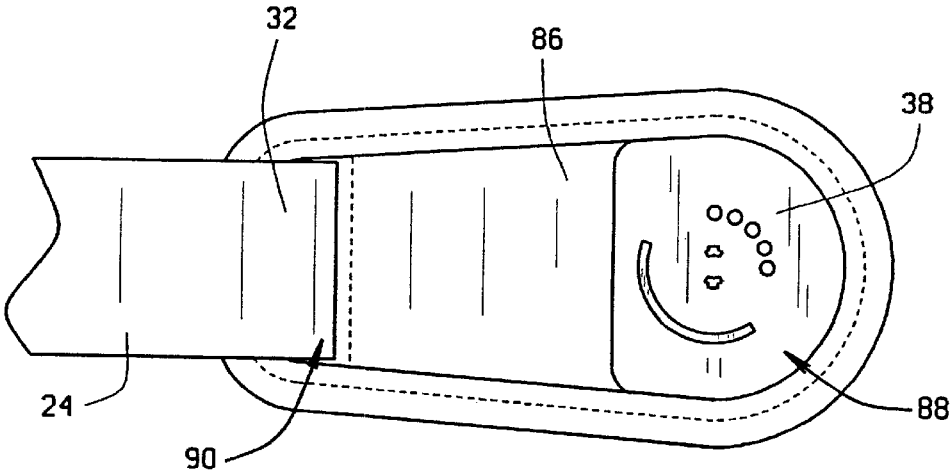
FIG. 4 is a partial view of an end portion of the strap of the piece of baggage of the preferred embodiment of the invention showing the male portion of a connector attached thereto.
Figure 5:
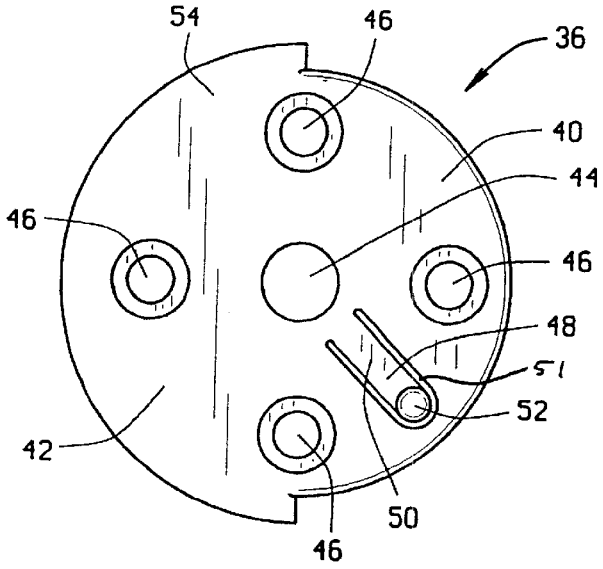
FIG. 5 is a front view of the female portion of the connector used to connect an end portion of the strap to the pack portion on the preferred embodiment of the piece of baggage of the invention.
Figure 6:
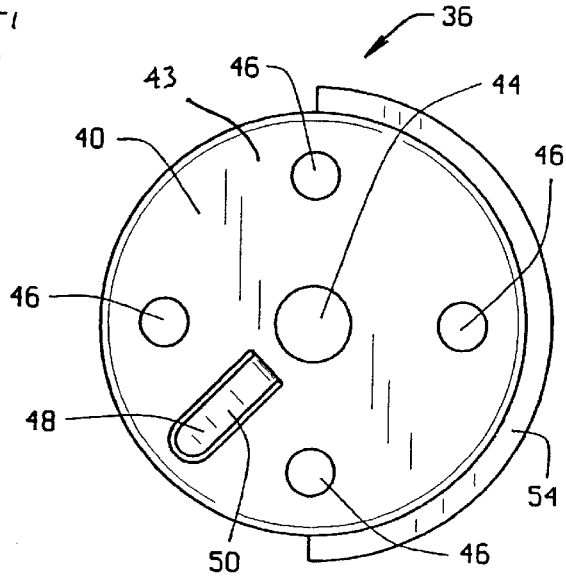
FIG. 6 is a rear view of the female portion of the connector shown in FIG. 5.
Figure 7:
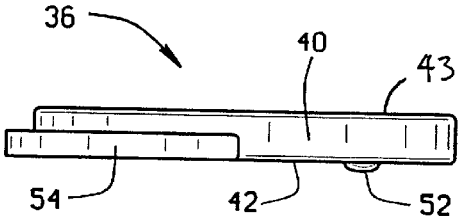
FIG. 7 is a top view of the female portion of the connector shown in FIG. 5.
Figure 8:
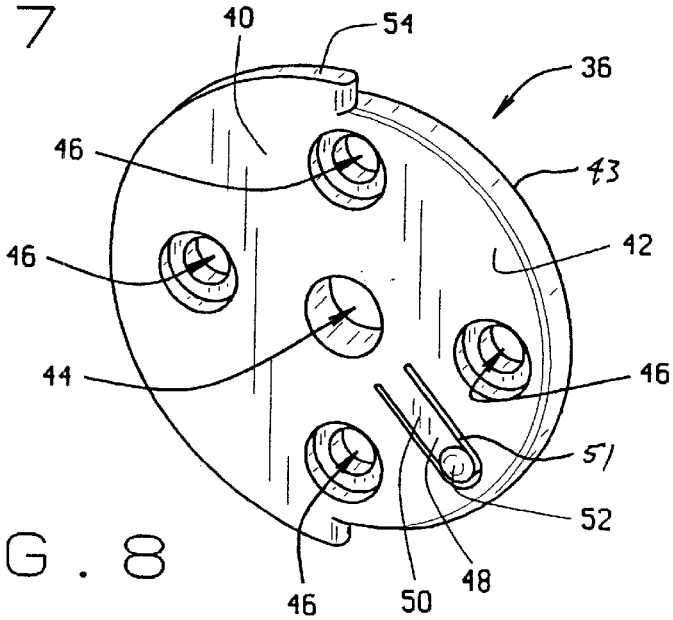
FIG. 8 is a perspective view of the female portion of the connector shown in FIG. 5.
Figure 9:
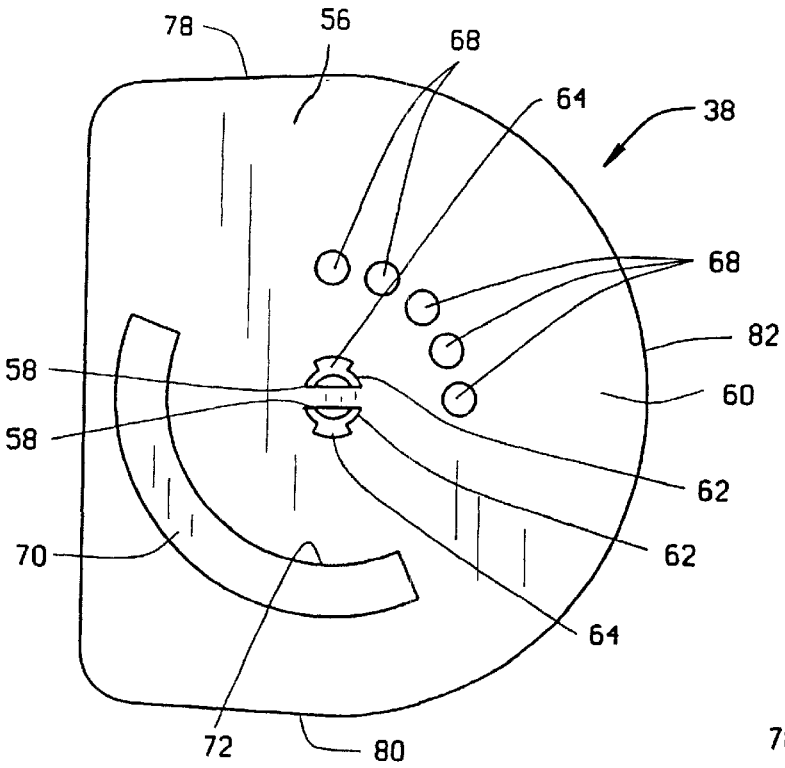
FIG. 9 is a front view of the male portion of a connector used to connect an end portion of the strap to the pack portion on the preferred embodiment of the piece of baggage of the invention.
Figure 10:
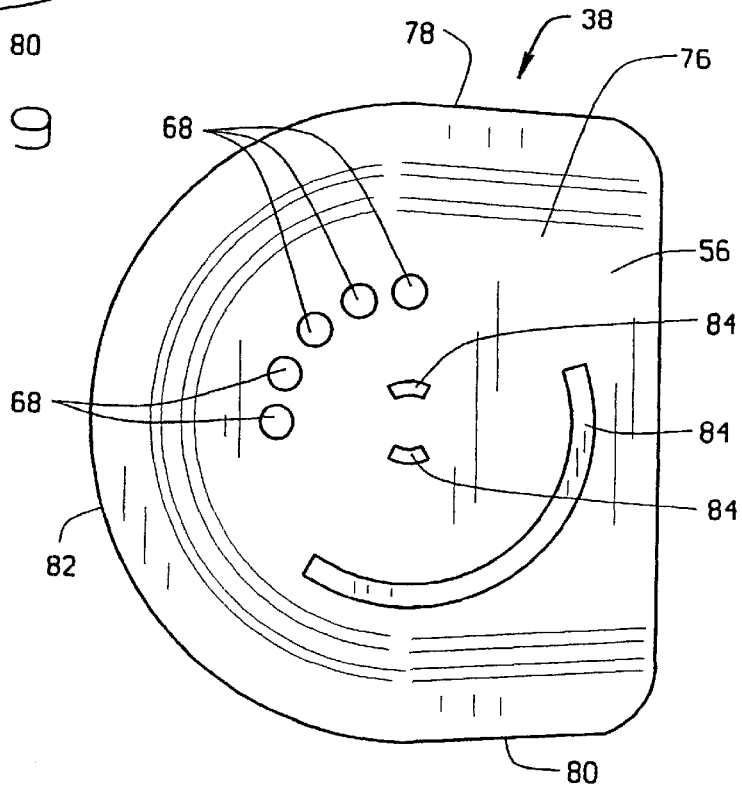
FIG. 10 is a rear view of the male portion of the connector shown in FIG. 9.
Figure 11:
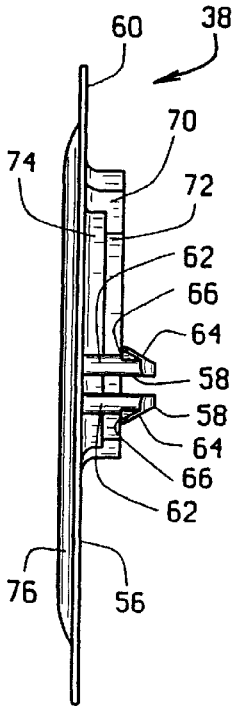
FIG. 11 is a right side view of the male portion of the connector shown in FIG. 9.
Figure 12:
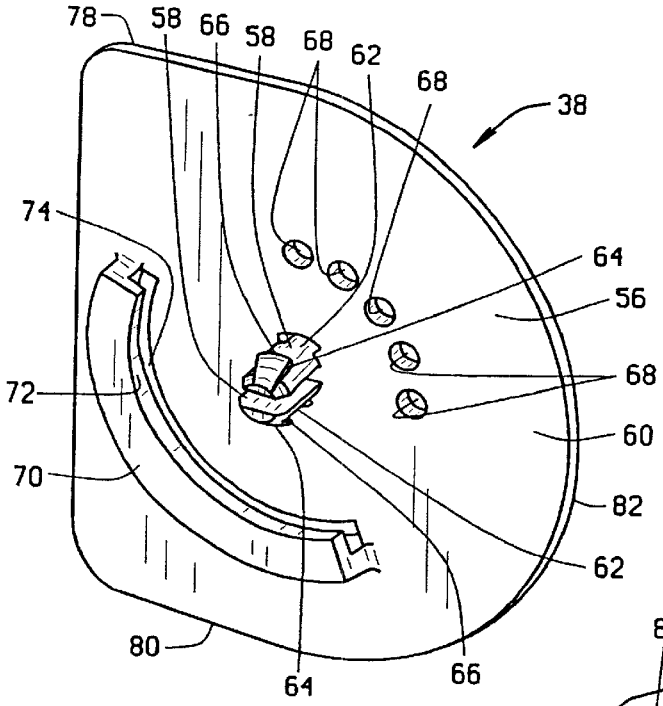
FIG. 12 is a front perspective view of the male portion of the connector shown in FIG. 9.
Figure 13:
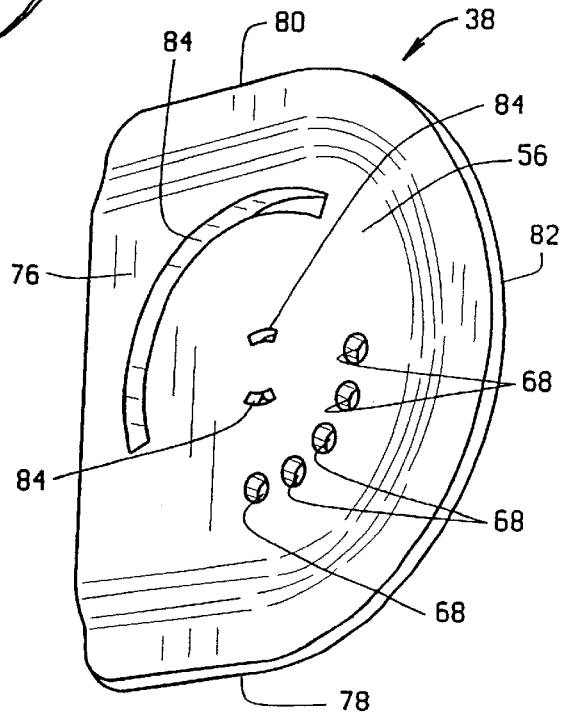
FIG. 13 is rear perspective view of the male portion of the connector shown in FIG. 9.

The male portion 38 of each connector 26 is preferably wrapped in an elongated covering 86 that is D-shaped at one end to match the shape of the male portion 38 of the connectors 26 and is preferably made of fabric or leather material similar to that of the pack portion 22 of the piece of baggage 20. As best shown in FIG. 4, the coverings 86 each have a D-shaped opening 88 at one end and a slot opening 90 at the other end.

The D-shaped opening 88 of each of the coverings 86 is slightly smaller than the D-shaped main body 56 of each male portion 38 of the connectors 26 such that the coverings extend around the perimeter of the male portion of the connector while substantially exposing the front face 60 thereof. The tapered thickness of the upper 78, lower 80, and semicircular edges 82 of the male portion 38 of the connector 26 allows the covering 86 to be sewn directly to such edges while the increased thickness of the mid section of the main body 56 provides the male portion 38 of the connector 26 with sufficient overall stiffness.

One of the end portions 32 of the strap 24 is positioned extending through the slot opening 90 at the other end of each covering 86 where it is sewn to the covering. Thus the coverings 86 provide a simplistic and aesthetically pleasing method of attaching the end portions 32 of the straps 24 to the male portions 38 of the connectors 26. The coverings 86 also provide padding over the connectors 26 as seen in FIG. 3 to reduce any discomfort when the piece of baggage 20 is worn as a lumbar pack and help prevent debris from obstructing the connectors.

During the manufacture of the piece of baggage 20 of the preferred embodiment, the male portion 38 of each connector 26 is secured to its complementary female portion 36 of the connector simply by positioning the male portion front face 60 opposite the female portion front face 42 and inserting the locking tabs 58 of the male portion into the through-hole 44 of the female portion. This is done with the male portion 38 positioned so that the arcuate ridge 54 of the female portion 36 is on the opposite side of the through-hole 44 from the arcuate flange 72 and slot 74 of the male portion 38. As the locking tabs 58 are inserted into the through-hole 44, the taper 64 of each of the locking tabs engage the cylindrical wall of the through-hole and cause the locking tabs to deflect toward each other. Once the front face 60 of the male portion 38 engages the front face 42 of the female portion 36, the tapers 64 and locking surfaces 66 of the locking tabs 58 are positioned beyond the through-hole 44 and the locking tabs resiliently return to their undeflected position. In the undeflected position the locking surfaces 66 of the locking tabs 58 engage the edge of the through-hole 44 to prevent the male portion 38 of the connector 26 from separating from the female portion 36.

Once assembled together, the semicylindrical surfaces 62 of the locking tabs 58 of the male portion 38 of each connector 26 act as a bearing surfaces for the through-hole 44 of the corresponding female portion 36 of the connector, allowing relative pivotal movement thereabout. The end portions 32 of the strap 24 can then be rotated into a practical orientation extending horizontally away from each other or upwardly from the pack portion 22. When rotated as such, the ridge 54 of the female portion 36 of each connector 26 engages in the slot 74 between the flange 72 and the front face 60 of the male portion 38 where it adds strength to the connector by resisting any prying forces that could otherwise act upon the locking tabs 58.

As the end portions 32 of the strap 24 are rotated between positions where they extend horizontally away from each other as shown in FIG. 2 and where they extend vertically upward from the pack portion 22 as shown in FIG. 1, the detent tab 48 of the female portion 36 of each connector 26 passes over the detent holes 68 of the male portion 38 of the connector. As the detent tab 48 passes between each adjacent pair of detent holes 68, the front face 60 of the male portion 38 of the connector 26 forces the semi-spherical protrusion 52 on the detent tab toward the front face 42 of the female portion 36 of the connector. This causes the arm portion 50 of the detent tab 48 to resiliently deflect. When the detent tab 48 is directly aligned with a detent hole 68, the resiliency of the arm portion 50 of the detent tab causes the semi-spherical protrusion 52 to move away from the front face 42 of the female portion of the connector 26 and into the detent hole. This "locks" the male portion 38 and female portion 36 of the connectors 26 in their current pivotal orientation relative to each other. A person must then exert a sufficient relative torque between the male portion 38 and female portion 36 of the connectors 26 to deflect the detent tab 48 from the hole 68 to allow relative pivotal movement to the next detent hole. It should be understood that the torque necessary to deflect the detent tab 48 from the detent holes 68 is dependent upon the stiffness of the material used to form the female portion 36 of the connector 26 and the dimension of the arm portion 50 of the detent tab 48.

With the connectors 26 adjusted such that the end portions 32 of the strap 24 extend horizontally away from each other as shown in FIG. 2, the piece of baggage 20 can be supported comfortably from a person's waist as a lumbar pack. The locking feature of the connectors 26 prevents the end portions 32 of the strap 24 from pivoting relative to the pack portion 22, thereby preventing the piece of baggage 20 from shifting relative to a wearer's hips. When desired, the piece of baggage 20 can be removed from the wearer's waist by disconnecting the quick-release buckle 34 of the strap 24. Once removed, the quick-release buckle 34 can be reconnected and the connectors 26 can be adjusted such that the end portions 32 of the strap 24 extend upwardly from the pack portion 22. The various detent positions of the connectors 26 allows the end portions 32 of the strap 24 to be locked extending at various angles upward from the pack portion 22 for alternatively supporting the piece of baggage 20 by suspending it straight downward from a shoulder or by suspending it around one's neck and shoulder. In any configuration, the length of the strap 24 can be adjusted as desired.

While the present invention has been described by reference to specific embodiments, it should be understood that modifications and variations could be made without departing from the scope of the invention defined in the following claims.

What is claimed:

1. A piece of baggage comprising:

a pack portion having a top and opposite sides;

a strap having opposite first and second end portions; and first and second connectors, the first connector operatively connecting the first end portion of the strap to the pack portion adjacent one of the opposite sides of the pack portion and the second connector operatively connecting the second end portion of the strap adjacent the other of the sides of the pack portion, the first and second connectors being configured such that the first and second end portions of the strap can be locked extending from the pack portion in at least first and second alternative orientations relative to the pack portion, the first and second end portions of the strap extending generally away from each other from the opposite sides of the pack portion when in the first orientation and extending upwardly from the top of the pack portion when in the second orientation.

2. The piece of baggage of claim 1, wherein:

the first and second end portions extend vertically from the top of the pack portion when the first and second end portions are in the second orientation relative to the pack portion.

3. The piece of baggage of claim 1, wherein:

the first and second connectors each have a pivot axis and the first and second end portions of the strap pivot about the pivot axis of the first and second connectors respectively as the first and second strap end portions are moved between the first and second alternative orientations relative to the pack portion.

4. The piece of baggage of claim 3, wherein:

the pack portion has a backside adjacent the top and between the opposite sides of the pack portion and the first and second connectors are directly attached to the backside of the pack portion.

5. The piece of baggage of claim 4, wherein:

the first and second strap end portions each have a width and thickness with the width being substantially larger than the thickness and each of the first and second connectors comprises two interlocked members that pivot relative to each other about the axis of the connector, one of the interlocked members of each connector being attached directly to the backside of the pack portion and the other of the interlocked members being connected to one of the first and second end portions of the strap in a manner such that the width of such strap end portion is held oriented collateral to the backside of the pack portion when the first and second strap end portions are in the first orientation and when the first and second strap end portions are in the second orientation.

6. The piece of baggage of claim 5, wherein:

each of the two interlocked members of each of the first and second connectors has a planar face that engages the face of the other of the two interlocked members of the corresponding connector, one of the two interlocked members of each of the first and second connectors has at least one protrusion extending perpendicular from its face and the other of the two interlocked members of each of the first and second connectors has a hole extending into its face, the at least one protrusion extending through the hole and acting as a pivot axle between the interlocked members.

7. A piece of baggage comprising:

a pack portion having a top and opposite sides;

a strap having opposite lengthwise first and second end portions each having a width and thickness, the width of each of the first and second end portions being substantially larger than its thickness; and first and second connectors, the first connector operatively connecting the first end portion of the strap to the pack portion adjacent one of the opposite sides of the pack portion and the second connector operatively connecting the second end portion of the strap adjacent the other of the sides of the pack portion, the first and second connectors being configured such that the first and second end portions of the strap can be locked extending from the pack portion in at least first and second alternative orientations relative to the pack portion, the first and second end portions of the strap extending in generally opposite horizontal directions from the opposite sides of the pack portion with the width of each of the first and second end portions being oriented vertically when the first and second end portions are in the first orientation, the first and second end portions of the strap extending upwardly from the top of the pack portion when the first and second end portions are in the second orientation.

8. The piece of baggage of claim 7, wherein:

the first and second end portions extend vertically from the top of the pack portion when the first and second end portions are in the second orientation relative to the pack portion.

9. The piece of baggage of claim 8, wherein: the first and second connectors each have a pivot axis and the first and second end portions of the strap pivot about the pivot axis of the first and second connectors respectively as the first and second strap end portions are moved between the first and second alternative orientations of the strap end portions relative to the pack portion.

10. The piece of baggage of claim 9, wherein:

the pack portion has a backside adjacent the top and between the opposite sides of the pack portion and the first and second connectors are directly attached to the backside of the pack portion.

11. A method of reversibly converting a piece of baggage from a piece of baggage configured to be supported from a person's shoulder to a piece of baggage configured to be supported from a person's waist, the method comprising:

providing a piece of baggage comprising a pack portion, a strap, and first and second connectors, the pack portion having a top and opposite sides, the strap having opposite first and second end portions;

operatively connecting the first end portion of the strap to the pack portion adjacent one of the opposite sides of the pack portion with the first connector;

operatively connecting the second end portion of the strap to the pack portion adjacent the of the sides of the pack portion with the second connector;

configuring the first and second connectors such that the first and second end portions of the strap can be locked extending from the pack portion in at least first and second alternative orientations relative to the pack portion;

positioning the first and second end portions of the strap so that they are locked extending upwardly from the top of the pack portion in the first orientation such that the piece of baggage is in a configuration for being supported from a person's shoulder;

repositioning the first and second end portions of the strap so that they are locked extending generally horizontally away from each other from the opposite sides of the pack portion in the second orientation such that the piece of baggage is in a configuration to be supported from a persons waist.

12. The method of claim 11, wherein:

the first and second end portions of the strap extend vertically from the top of the pack portion when the first and second end portions are positioned in the first orientation.

13. The method of claim 11, further comprising:

providing each of the first and second connectors with a pivot axis and pivoting the first and second end portions of the strap about the pivot axes of the first and second connectors respectively as the first and second end portions are repositioned from the first orientation to the second orientation relative to the pack portion.

* * * * *